US005886308A

United States Patent [19]

Ericson et al.

[11] Patent Number: 5,886,308

[45] Date of Patent: Mar. 23, 1999

[54] ROPE SPEED MONITORING ASSEMBLY AND METHOD

[75] Inventors: Richard J. Ericson, Southington, Conn.; Hugh J. O'Donnell, Longmeadow, Mass.; Thomas J. Hoffman, Unionville, Conn.

[73] Assignee: Otis Elevator Company, Farmington, Conn.

[21] Appl. No.: 996,373

[22] Filed: Dec. 22, 1997

[51] Int. Cl.[6] ..... B66B 1/34

[52] U.S. Cl. ..... 187/393; 187/391

[58] Field of Search ..... 187/391, 393, 187/394, 287

[56] References Cited

U.S. PATENT DOCUMENTS

| | | | |
|---|---|---|---|
| 4,145,920 | 3/1979 | Yamagami | 73/158 |
| 4,218,671 | 8/1980 | Lewis | 187/394 |
| 4,427,940 | 1/1984 | Hirama et al. | 324/240 |
| 4,467,895 | 8/1984 | Smith et al. | 187/391 |
| 5,070,967 | 12/1991 | Katzy et al. | 187/297 |
| 5,637,842 | 6/1997 | Yonemoto et al. | 187/294 |

FOREIGN PATENT DOCUMENTS

| | | | |
|---|---|---|---|
| 5-310377 | 11/1993 | Japan | 187/393 |

*Primary Examiner*—Robert E. Nappi

[57] ABSTRACT

An elevator rope speed monitoring assembly is disclosed. The rope speed monitoring assembly includes a plurality of sensors that monitor the movement of the individual ropes. The sensors output a signal indicative of the speed of the movement of the ropes. A controller compares the relative movement of the ropes and generates a warning signal if a sufficient deviation between relative rope speeds is detected.

9 Claims, 2 Drawing Sheets

ROPE SPEED MONITORING ASSEMBLY AND METHOD

TECHNICAL FIELD

The present invention relates to elevator systems, and more particularly to methods and assemblies for monitoring elevator ropes.

BACKGROUND OF THE INVENTION

Hoisting ropes for elevators are used to provide the necessary lifting forces and traction forces for moving the elevator car. Hoisting ropes are typically formed from steel wire strands woven together to form the rope. Such hoisting ropes have proven to be very durable and dependable. A drawback to the use of steel wire ropes is their weight. As the rise of the elevator increases, the portion of the load resulting from the mass of the rope increases. This produces a limitation on the rise of the elevator and the required output of the lifting equipment.

Lightweight, non-metallic materials have been suggested to replace the steel wire ropes. High strength, polyaramid materials, such as KEVLAR, are being investigated for use in elevator applications. These ropes would be formed from polyaramid fibers woven to form strands, which are then woven together to form the rope. An outer jacket may then be used to protect the woven fibers from damage and wear, and to provide the necessary traction to move the elevator car.

An area of concern is how to inspect such synthetic ropes to determine if the rope should be discarded and replaced with a new rope. The current inspection methods for steel wire rope includes visually inspecting the rope to determine the number of broken steel wires in a given length of steel rope. If a predetermined maximum number of broken wires is detected, the steel rope is discarded. This method is not applicable to synthetic fiber ropes having an outer jacket.

One previously known method is to place an electrically conductive member within the rope. The status of the conductive member may be tested by applying an electrical current to the member. If damage occurs to an extent great enough to break the conductive member, the electrical circuit is broken. There are several drawbacks to this method. First, there is no assurance that the loss of electrical continuity is the result of damage to the rope. Second, there is no qualitative information to indicate if the rope is degrading during use. The first indication is provided by the broken conductive member.

The above art notwithstanding, scientists and engineers under the direction of Applicants' Assignee are working to develop methods and apparatus to monitor hoisting ropes.

DISCLOSURE OF THE INVENTION

The present invention is predicated in part upon the recognition that as a hoisting rope degrades, the fibers and strands begin to fail. This will cause the remaining fibers and strands to carry greater loads, which will lead to greater elongation of those fibers and strands. If a particular rope in a elevator system is failing prematurely, the additional elongation relative to the remaining ropes will need to be compensated as the ropes travel over the sheave. This compensation will most dramatically occur when the car is at its highest or lowest points in the hoistway, and is particularly a problem in high rise buildings that have long ropes. If elongation occurs, the longer rope will suddenly slip or slide on the sheave in order to equalize loads in this rope. Monitoring the relative movement of the ropes provides a method to monitor the condition of the ropes.

According to the present invention, rope monitoring assembly includes a speed monitoring device that senses the speed of each of a plurality of ropes. As a result, if the speed monitoring device senses that one of the ropes is moving at a different velocity than the other ropes, this is an indication that that rope may be failing prematurely.

Upon determining that one or more of the sensed rope speeds deviates from the others by more than a predetermined threshold, the controller generates a warning signal. The warning signal indicates that the ropes require inspection and/or replacement. As an alternative, the sensed rope speeds and/or the warning signal from the controller may be communicated with an remote monitoring system for the elevator system. In this configuration, the information could be used to dispatch a service representative to inspect the ropes.

In particular embodiments, the speed monitoring device may be an encoder engaged with the ropes or a non-contact sensor, such as an optical sensor or proximity sensor, that responds to the movement of the ropes.

According to another embodiment of the present invention, a method to monitor ropes includes the steps of sensing the speed of each rope and comparing the relative rope speeds.

The foregoing and other objects, features and advantages of the present invention become more apparent in light of the following detailed description of the exemplary embodiments thereof, as illustrated in the accompanying drawings.

BEST MODE FOR CARRYING OUT THE INVENTION

Figure 1:
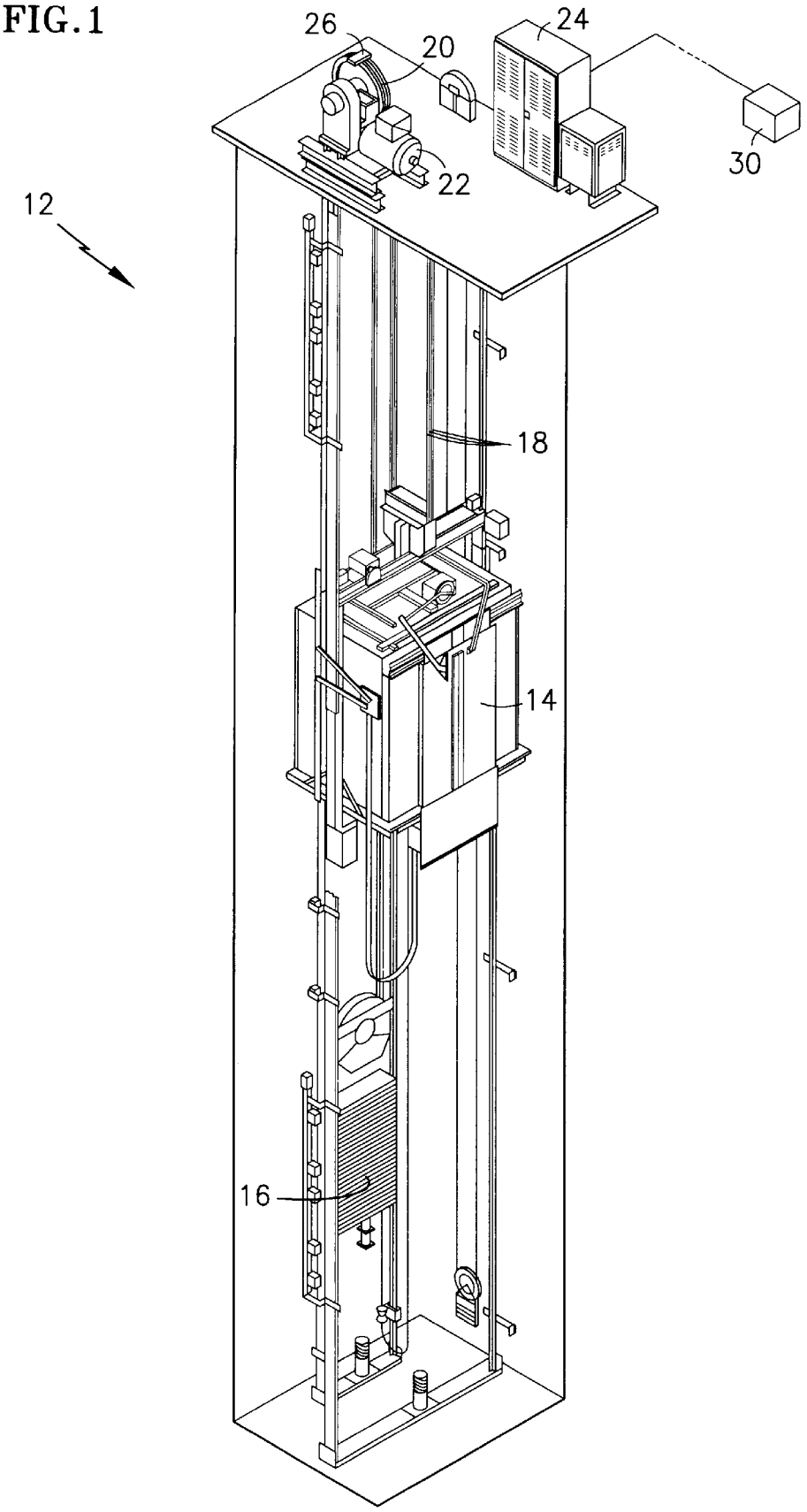
FIG. 1 is an illustration of an elevator system.

Illustrated in FIG. 1 is an elevator system 12. The elevator system 12 includes a car 14, a counterweight 16, and a plurality of ropes 18 extending over a traction sheave 20 and connecting the car 14 and counterweight 16. The traction sheave 20 is rotated by a machine 22. The operation of the elevator system 12 is controlled by a controller 24 that communicates with the car 14, the machine 22, and various other devices and switches in the elevator system 12.

Figure 2:
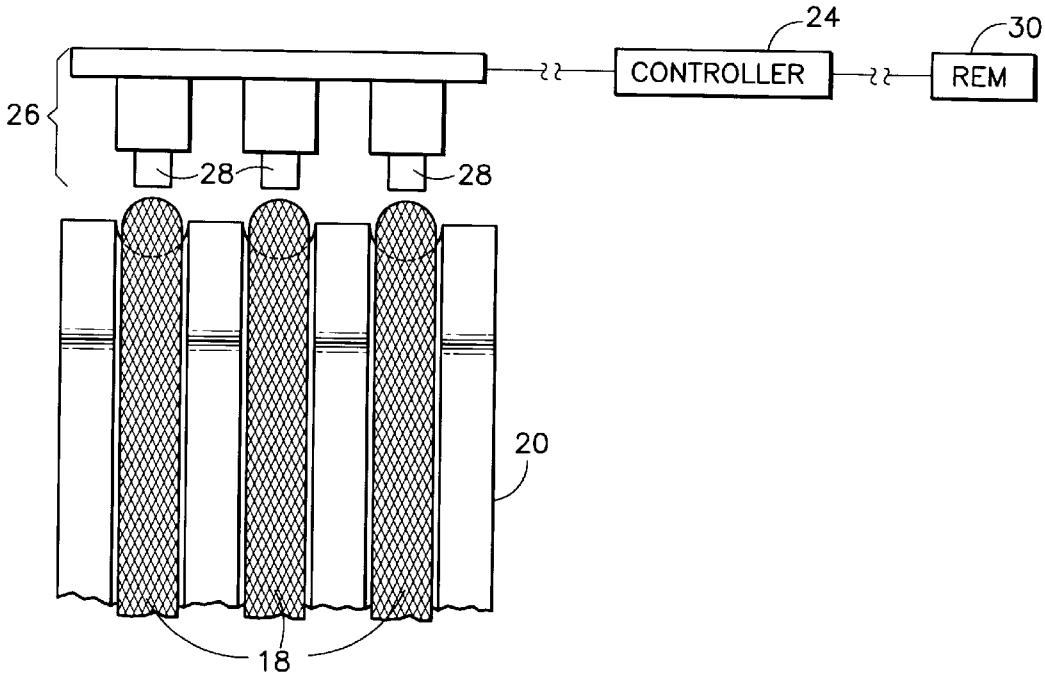
FIG. 2 is an illustration of a rope speed monitoring assembly.

Also shown in FIG. 1 is a rope speed monitoring assembly 26 that is mounted adjacent to the traction sheave 20. The monitoring assembly 26 detects the speed of the individual ropes 18 as they pass over the traction sheave 20. As shown more clearly in FIG. 2, the rope speed monitoring assembly 26 includes a plurality of sensors 28, with each of the sensors 28 being located proximate to one of the plurality of ropes 18. As shown in FIG. 2, the sensors 28 are optical sensors that detect motion of the ropes 18. An advantage of this type of sensor 28 is that there is no contact between the sensor 28 and the rope 18. Other types of non-contact sensors that detect motion may also be applied, such as inductive proximity sensors. In another variation, a particular sensor may be combined with a triggering device embedded in the rope, such as a magnetic sensor that is responsive to magnetic bodies that are embedded in and spaced along the rope.

Each sensor 28 monitors one rope 18 and produces an output signal that corresponds to the speed of the rope 18.

The plurality of output signals are communicated to the controller 24. The controller 24 then analyzes the signals to determine if there is a deviation in speed between the ropes 18. Upon a determination that a deviation in rope 18 speed has occurred, the controller 24 generates a warning signal. This warning signal may be stored in the controller 24 for subsequent review by an elevator mechanic or may be further communicated to a remote elevator monitoring system 30. If the deviation is sufficiently large to indicate that a failure may occur, the controller 24 may shut down the operation of the elevator system 12 until an inspection of the ropes 18 has been performed.

During operation, the machine 22 rotates the traction sheave 20 and the ropes 18 are driven by the traction forces between the sheave 20 and the rope 18 surfaces. Under normal conditions, all of the ropes 18 will be moving at the same speed as the car 14 and counterweight 16 move through the hoistway from landing to landing. Therefore, in this condition the rope speed monitoring assembly 26 will not detect a deviation of sufficient magnitude to generate a warning signal or to shut down the elevator system 12.

In the event that one of the ropes 18 becomes damaged or degrades prematurely, this rope 18 will experience elongation greater than the remaining ropes 18. As a result, this rope 18 will become longer than the other ropes 18 and equalization will occur when the car 14 and counterweight 16 are at the highest or lowest locations in the hoistway. This equalization is necessary to accommodate the addition length of the damaged or worn rope 18 and the variation in tension that will occur in the rope 18 on opposite sides of the sheave 20.

The equalization will manifest itself by a sudden slipping or jumping of the rope 18 on the sheave 20 as the elongated rope 18 overcomes the traction forces and moves relative to the sheave 20 (and the remaining ropes 18). This movement will continue until the tension in the rope 18 is relatively equal on both sides of the sheave 20 or until the difference in tension is insufficient to overcome the traction forces. Although such movement will be most significant with the car 14 and counterweight 16 stopped at extreme locations in the hoistway, it may also be observed during other operational conditions.

The rope speed monitoring assembly 26 will detect this equalization movement by the elongated rope 18 and communicate this to the controller 24. When the controller 24 compares the speed of this rope 18 to the sensed speed of the remainder of the ropes 18, a deviation in the rope 18 speeds will be detected. If this deviation exceeds a first predetermined threshold, the controller 24 will generate the warning signal. If the deviation exceeds a second predetermined threshold, the elevator system 12 will be shut down by the controller 24 until an inspection has occurred.

Although described as particularly advantageous for elevator systems having fiber or non-metallic ropes, the present invention also has applications to elevator systems that use conventional steel wire ropes. In this application, the rope speed monitoring device can be used to monitor for slack rope conditions that will generate the sudden slipping or sliding of the ropes on the sheave. Such movement by steel wire ropes may lead to damage to the sheave as a result of the abrasive movement between the rope and sheave. Upon detection of this condition, a warning signal may be generated to indicate the need for correction of the cause of the problem.

Although described as being a rope speed monitoring assembly 26 that monitors the ropes 18 during the operation of the elevator system, it should be apparent to those skilled in the art that the invention may also be deployed as an inspection device. In addition, rather than continually monitoring the ropes 18 during the operation of the elevator system 12, the rope speed monitoring assembly 26 may be limited to communicating ropes 18 movements or speeds when the car 14 is stopped at a particular landing, such as the highest or lowest landings in the hoistway.

Figure 3:
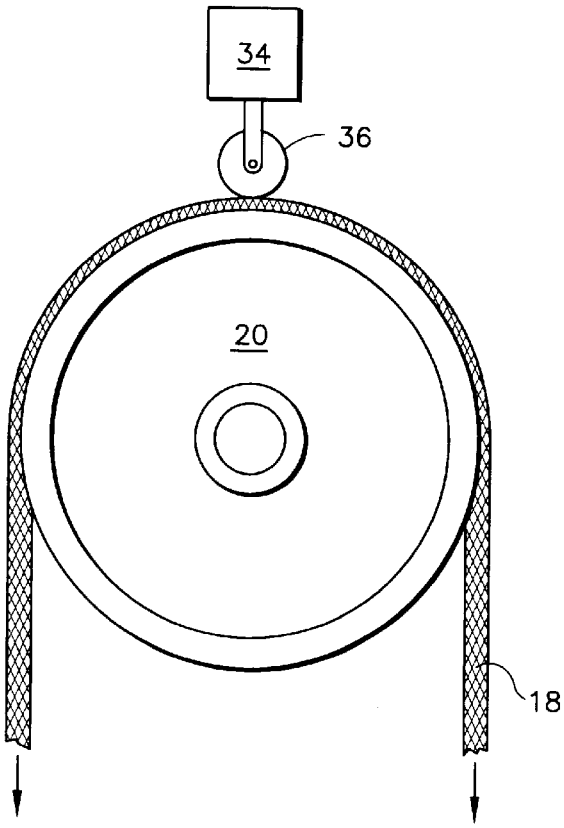
FIG. 3 is an alternate embodiment of the rope speed monitoring assembly.

An alternate embodiment of the rope monitoring system is illustrated in FIG. 3. In this embodiment, the rope speed monitoring assembly 26 includes a plurality of rotary encoder devices 34 that engage the ropes 18. Each rotary encoder device 34 includes a wheel 36 that is in contact with one of the ropes 18. Traction forces between the rope 18 and wheel 36 cause the wheel 36 to rotate at a speed corresponding to the speed of movement of the rope 18. The rotary encoder device 34 then generates a signal that corresponds to the speed of rotation of the wheel 36, and thereby the speed of movement of the rope 18, and communicates this signal to the controller 24. This embodiment is particularly advantageous for use with ropes that have outer jackets. It may not be possible to use an optical type sensor in these applications due to the uniformity of the jackets.

Although the invention has been shown and described with respect to exemplary embodiments thereof, it should be understood by those skilled in the art that various changes, omissions, and additions may be made thereto, without departing from the spirit and scope of the invention.

What is claimed is:

1. A rope monitoring assembly for an elevator system, the elevator system including a car, a sheave, and a plurality of ropes that extend over the sheave and are attached to the car, the rope monitoring system including a speed monitoring device that senses the speed of each of the plurality of ropes and a controller that compares the relative rope speeds proximate to the sheave.

2. The rope monitoring assembly according to claim 1, wherein the speed monitoring device is an encoder engaged with the ropes and that produces a signal that correlates to the speed of the ropes.

3. The rope monitoring assembly according to claim 1, wherein the speed monitoring device is an optical sensor that produces a signal that correlates to the speed of the ropes.

4. The rope monitoring assembly according to claim 1, wherein the speed monitoring device is a proximity sensor that produces a signal that correlates to the speed of the ropes.

5. The rope monitoring assembly according to claim 1, wherein the controller generates a warning signal if the sensed speed of one of the plurality of ropes deviates from the sensed speed of the others of the plurality of ropes.

6. The rope monitoring assembly according to claim 5, wherein the controller compares the deviation in speed to a predetermined deviation level and generates the warning signal if the deviation exceeds the predetermined deviation level.

7. A method to monitor ropes in an elevator system, the elevator system including a car and a sheave, wherein the plurality of ropes extend over the sheave and are attached to the car, the rope monitoring method including the steps of:

sensing the speed of each of the plurality of ropes relative to the sheave; and comparing the relative rope speeds.

8. The method according to claim 7, further including the step of generating a warning signal if the sensed speed of one of the plurality of ropes deviates from the sensed speed of the others of the plurality of ropes.

9. The method according to claim 8, further including the step of comparing the deviation in speed to a predetermined deviation level, and wherein the step of generating the warning signal is performed if the measured deviation exceeds the predetermined deviation level.

* * * * *